United States Patent [19]

Reich

[11] Patent Number: 4,645,413

[45] Date of Patent: Feb. 24, 1987

[54] FRICTION PUMP

[75] Inventor: Günter Reich, Cologne, Fed. Rep. of Germany

[73] Assignee: Leybold-Heraeus GmbH, Cologne, Fed. Rep. of Germany

[21] Appl. No.: 610,333

[22] Filed: May 15, 1984

[30] Foreign Application Priority Data

May 17, 1983 [DE] Fed. Rep. of Germany ..... 3317868

[51] Int. Cl.[4] ..... F01D 1/36

[52] U.S. Cl. ..... 415/72; 415/90; 415/212 A

[58] Field of Search ..... 415/72, 75, 90, 212 R, 415/212 A, 73, 74, 76; 416/241 A, 198 A

[56] References Cited

U.S. PATENT DOCUMENTS

| | | | |
|---|---|---|---|
| 158,599 | 1/1875 | Fairfax | 415/76 |
| 1,331,997 | 2/1920 | Neal | 416/198 |
| 3,168,977 | 2/1965 | Garnier et al. | 415/90 |
| 3,947,193 | 3/1976 | Maurice | 415/143 |
| 4,309,143 | 1/1982 | Klatt et al. | 415/90 |

FOREIGN PATENT DOCUMENTS

| | | |
|---|---|---|
| 605902 | 11/1934 | Fed. Rep. of Germany . |
| 625444 | 2/1936 | Fed. Rep. of Germany . |
| 912007 | 5/1954 | Fed. Rep. of Germany . |
| 1010235 | 11/1957 | Fed. Rep. of Germany . |
| 101871 | 10/1923 | Switzerland . |
| 222288 | 12/1942 | Switzerland . |
| 501840 | 2/1971 | Switzerland . |
| 529927 | 12/1972 | Switzerland . |
| 564692 | 7/1975 | Switzerland . |
| 332879 | 7/1930 | United Kingdom . |

OTHER PUBLICATIONS

"Theorie und Praxis der Vaccumtechnik," Wutz, Adam and Walcher, pp. 202–221.

*Primary Examiner*—Edward K. Look
*Assistant Examiner*—Joseph M. Pitko
*Attorney, Agent, or Firm*—Felfe & Lynch

[57] ABSTRACT

A friction pump (molecular pump, turbomolecular pump) has pumping surfaces which include surface areas which face upstream as well as surface areas which face downstream with respect to the pumping direction. In at least a portion of the pumping surfaces, surface areas of different roughness are present, such that the roughness of the surface areas facing downstream with respect to the pumping direction is greater than the roughness of the surface areas facing upstream with respect to the pumping direction.

9 Claims, 2 Drawing Figures

FRICTION PUMP

BACKGROUND OF THE INVENTION

The invention relates to a friction pump having pumping surfaces which include areas facing upstream as well as areas facing downstream with respect to the pumping direction.

Molecular pumps and turbomolecular pumps, whose manner of operation is described in detail in the textbook by Wutz, Adam and Walcher entitled "Theorie und Praxis der Vacuumtechnik," pp. 202 sqq., are classed as friction pumps.

In molecular pumps, a moving rotor wall and a stationary stator wall are so configured and spaced apart from one another that the impulses transmitted by the walls to gas molecules situated between them have a preferential direction. As a rule, the rotor wall and/or stator wall are equipped with flute-like indentations or riffles for the achievement of the preferential direction. Molecular pumps operating on this principle are known from German Pat. Nos. 605,902, 625,444, 912,007, 1,010,235 and Swiss Pat. Nos. 101,871, 222,288, as well as from British Pat. No. 332,879.

In recent times turbomolecular pumps have gained favor over molecular pumps. These have intermeshing rows of stator and rotor blades in the manner of a turbine. Different embodiments of turbomolecular pumps are known from Swiss Pat. Nos. 501,840, 529,927, and 564,692, and from German Auslegeschrift No. 1,428,239. By the appropriate arrangement of the stator and rotor vanes it is likewise brought about that more particles are driven in one direction than in the opposite direction.

Lastly, a combination friction pump is known from German Offenlegungsschrift No. 2,412,624. This pump is designed on the suction side as a turbomolecular pump and on the discharge side as a friction pump.

The present invention is addressed to the problem of improving the pumping properties of a friction pump.

SUMMARY OF THE INVENTION

This problem is solved by the invention in that, in at least a part of the pumping surfaces, areas of different roughnesses are present, such that the roughness of the surface areas facing upstream with respect to the pumping direction is greater than the roughness of the surface areas facing downstream. These measures have surprisingly resulted in the desired improvement of the pumping properties.

It had heretofore always been assumed that the reflection of gas particles is equal on all surfaces, being even generally "diffuse," both as regards direction and velocity. The improved pumping properties show, however, that the surface properties of the pumping surfaces do have an influence on the reflection of gas particles. Evidently, on very smooth and clean surfaces a certain percentage of the particles is reflected optically, which results in reduced friction, while in the case of rougher surfaces a scattering of impinging particles and hence increased friction can occur. Furthermore, optically reflected particles in a turbomolecular pump are preferentially driven or passed through in both directions, while scattered particles are driven or passed, as the case may be, to a substantially lesser degree. Lastly, other considerations show that particles which are to be driven impinge preferentially on the areas of the pumping surfaces which face downstream, and that particles which move in the opposite direction impinge preferentially on the upstream-facing areas of the pumping surfaces. On the basis of these different assumptions and considerations, therefore, an increase of the compression capacity is achieved if the areas of the pumping surfaces facing downstream with respect to the pumping direction are roughened. Furthermore an increase in the suction capacity is to be expected if the pumping surface areas facing upstream with respect to the pumping direction have a particularly low roughness.

From the reasons described, it is therefore advantageous to dispose the surface areas of reduced roughness preferably in the suction part of the pump and the surface areas of increased roughness in the discharge part of the pump. A particularly good suction capacity in the suction part and an improvement of the compression in the discharge part can thereby be achieved.

Turbomolecular pumps known at this time have rotor blades and stator blades as pumping surfaces. These are either milled or turned, so that their surface has a roughness depending on this machining process. Usually, a standardized roughness Rz of about 8 microns is chosen. This corresponds to a mean roughness Ra of about 1.6 microns. In turbomolecular pumps made in this manner, therefore, a lesser or greater roughness can be achieved by performing the milling or turning process at different feed rates. A low feed results in a reduction of the roughness, and a faster feed in increased roughness. It is desirable that the working of the surfaces by turning or milling be performed such that the regular, parallel grooves that result and that form the increased roughness can be disposed approximately radially, i.e., perpendicular to the direction of rotation.

A reduction of the roughness can also be achieved by polishing, electrochemical treatment, lapping or grinding. Desirable roughnesses which can be achieved without great effort are Rz=1.2 microns (corresponding to Ra=0.2 microns).

To increase the roughness of corresponding surface areas, it is furthermore possible to sand them or lap them with emery. The roughness of surfaces treated in this manner is irregular. Desirable roughnesses are Rz=20 microns (corresponding to Ra=3.1 microns).

In accordance with the invention, a friction pump comprises pumping surfaces which include surface areas facing upstream as well as surface areas facing downstream with respect to the pumping direction. At least in a portion of the pumping surfaces, surface areas of different roughness are present, such that the roughness of the surface areas facing downstream is greater than the roughness of the surface areas facing upstream with respect to the pumping direction.

Also in accordance with the invention, a method of making a friction pump described in the preceding paragraph comprises polishing, electrochemically treating, lapping or grinding at least a portion of the pumping surface areas facing upstream to reduce roughness and sanding or emerying the upstream surface areas to increase roughness.

For a better understanding of the present invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings.

DESCRIPTION OF THE PREFERRED EMBODIMENTS

Figure 1:
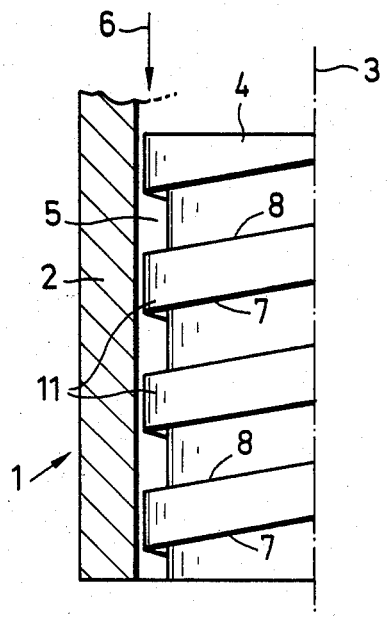
FIG. 1 is a diagrammatic, fragmentary, sectional view of a friction pump constructed in accordance with the invention.

FIG. 1 shows a portion of the pumping surfaces of a molecular pump 1. The latter includes the casing 2 and the rotor 4 journaled therein on the axis 3. The rotor has on its exterior helical grooves 5 which together with the inner surface of the casing 2 forms the pumping surfaces. The pitch of the grooves 5 determines the pumping direction, which is indicated by the arrow 6. In this manner boundary surfaces 7 and 8 are defined which are facing either in the upstream direction 6 or in the opposite direction. For the improvement of the pumping properties of such a friction pump, at least a part of the surface 8 facing upstream against the pumping direction 6 has a reduced roughness. A further improvement of the pumping properties can be achieved by roughening at least a part of the surfaces 7 facing downstream, away from the force in the pumping direction 6.

The friction pump represented in FIG. 1 could be described by saying that the rotor is equipped on its outer side with spiral riffles 11. The surface areas 7 and 8 could then be considered as boundary surfaces of the riffles.

Figure 2:
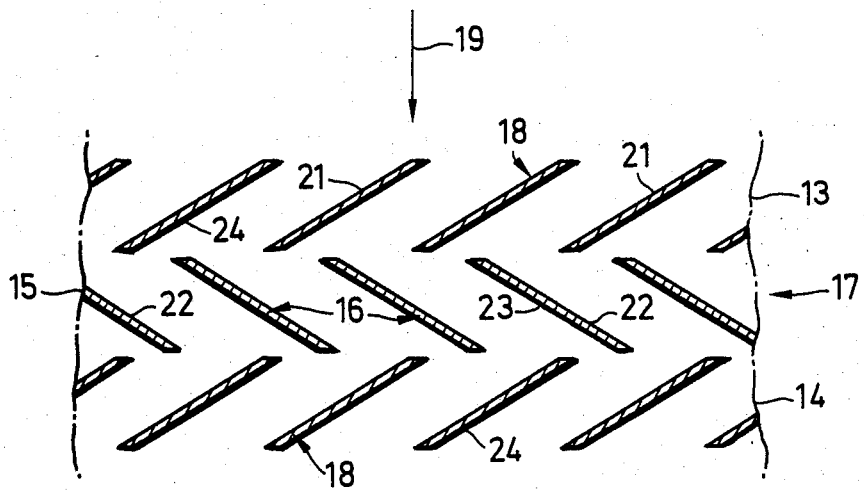
FIG. 2 is a diagrammatic, fragmentary, sectional view of a turbomolecular pump constructed in accordance with the invention.

FIG. 2 shows a developed partial cross section through a turbomolecular pump taken along a circle concentric with the axis of rotation of the rotor through two rows of stator blades 13 and 14 and a row of rotor blades 15. The rotor blades 16 move in the direction of the arrow 17 and thus, together with the stator blades, they define a pumping direction which is identified by the arrow 19.

The pumping properties of a turbomolecular pump of this kind can be improved in accordance with the invention by providing the surfaces 21 of the stator blades 18 which are facing in the upstream direction 19, and/or the surfaces 22 of the rotor blades 16, with a reduced roughness and/or providing the surfaces 23, 24 facing downstream with an increased roughness.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A friction vacuum pump comprising:

pumping surfaces which include surface areas facing upstream as well as surface areas facing downstream with respect to the pumping direction, at least in a portion of the pumping surfaces, surface areas of different roughness being present, such that the roughness of the surface areas facing downstream is greater than the roughness of the surface areas facing upstream with respect to the pumping direction.

2. A friction vacuum pump in accordance with claim 1 in which, to increase the suction capacity, the surface areas facing upstream with respect to the pumping direction have a roughness that is less than the standardized roughness.

3. A friction vacuum pump in accordance with claim 2 in which the surface areas of reduced roughness lie in the suction area of the pump.

4. A friction vacuum pump in accordance with claim 1 in which, to increase the compression capacity, the surface areas facing downstream with respect to the direction of pumping have a roughness greater than the standardized roughness.

5. A friction vacuum pump in accordance with claim 4 in which the surface areas of increased roughness lie in the discharge area of the pump.

6. A molecular vacuum pump comprising:

members including a stator and a rotor and one or more grooves on at least one of said members in which the lateral surfaces defining the groove have at least partially different roughnesses.

7. A molecular vacuum pump comprising:

members including a stator and a rotor and one or more riffles on at least one of said members in which the lateral boundary walls of the riffles have at least partially different roughnesses.

8. A turbomolecular vacuum pump comprising:

rotor blades and stator blades in which, in at least a part of the blades, the surface areas facing downstream with respect to the direction of pumping have a greater roughness than the surface areas facing upstream with respect to the pumping direction.

9. A turbomolecular vacuum pump in accordance with claim 8 and having a suction part, in which the blades situated in the suction part of the pump have a reduced roughness on their side facing upstream with respect to the pumping direction and the blades situated in the discharge part of the pump have an increased roughness on their downstream side with respect to the pumping direction.

* * * * *